US010565909B2

(12) United States Patent
Xu et al.

(10) Patent No.: US 10,565,909 B2
(45) Date of Patent: Feb. 18, 2020

(54) TEST METHOD FOR DISPLAY PANEL, AND TEST DEVICE

(71) Applicant: BOE TECHNOLOGY GROUP CO., LTD., Beijing (CN)

(72) Inventors: Pan Xu, Beijing (CN); Guangcai Yuan, Beijing (CN); Yongqian Li, Beijing (CN); Dongxu Han, Beijing (CN)

(73) Assignee: BOE Technology Group Co., Ltd, Beijing (CN)

( * ) Notice: Subject to any disclaimer, the term of this patent is extended or adjusted under 35 U.S.C. 154(b) by 76 days.

(21) Appl. No.: 15/540,752

(22) PCT Filed: Nov. 9, 2016

(86) PCT No.: PCT/CN2016/105212
§ 371 (c)(1),
(2) Date: Jun. 29, 2017

(87) PCT Pub. No.: WO2017/118212
PCT Pub. Date: Jul. 13, 2017

(65) Prior Publication Data

US 2018/0005556 A1 Jan. 4, 2018

(30) Foreign Application Priority Data

Jan. 5, 2016 (CN) ..... 2016 1 0005272

(51) Int. Cl.
*G09G 3/00* (2006.01)
*G09G 3/3225* (2016.01)

(52) U.S. Cl.
CPC ..... *G09G 3/006* (2013.01); *G09G 3/3225* (2013.01); *G09G 2310/08* (2013.01); *G09G 2330/02* (2013.01); *G09G 2330/10* (2013.01)

(58) Field of Classification Search
CPC ..... G09G 3/006; G09G 3/3225; G09G 3/00
(Continued)

(56) References Cited

U.S. PATENT DOCUMENTS 9,066,408 B2 6/2015 Choi et al.
9,171,504 B2 10/2015 Azizi et al.
(Continued)

FOREIGN PATENT DOCUMENTS

CN 1667682 A 9/2005
CN 101364370 A 2/2009
(Continued)

OTHER PUBLICATIONS

International Search Report of PCT/CN2016/105212 in Chinese, dated Jan. 26, 2017 with English translation.
(Continued)

*Primary Examiner* — Fred Tzeng
(74) *Attorney, Agent, or Firm* — Collard & Roe, P.C.

(57) ABSTRACT

A test method of a display panel and a test device are disclosed. The test method includes outputting a data signal of a preset test image to the display panel to cause plural light emitting elements to emit light according to the preset test image; outputting a starting signal to a scan circuit in the display panel to cause the scan circuit to output an active level of a switching circuit to the plural rows of first scan lines as connected, successively, according to a preset timing sequence; receiving a sensing signal from a sensor circuit, including voltage value information of a first terminal of every light emitting element; comparing the voltage value information of the first terminal of every light emitting element with the preset test image to obtain a test result. The test method solves the problem of missing detection of Mura.

20 Claims, 3 Drawing Sheets

(58) Field of Classification Search
USPC ..... 345/690
See application file for complete search history.

(56) References Cited

U.S. PATENT DOCUMENTS

| | | | | |
|---|---|---|---|---|
| 2005/0200574 | A1 | 9/2005 | Goto et al. | |
| 2009/0040198 | A1 | 2/2009 | Lu et al. | |
| 2010/0225770 | A1* | 9/2010 | Morimoto | G09G 3/006 348/189 |
| 2011/0254971 | A1* | 10/2011 | Saito | G06T 5/50 348/222.1 |
| 2014/0329339 | A1* | 11/2014 | Chaji | G01R 31/26 438/10 |
| 2014/0354700 | A1* | 12/2014 | Hong | G09G 3/006 345/690 |
| 2014/0374703 | A1* | 12/2014 | Jung | H01L 51/0031 257/40 |
| 2015/0379910 | A1* | 12/2015 | Nishinohara | G09G 3/006 345/206 |
| 2017/0053577 | A1 | 2/2017 | Cao et al. | |
| 2017/0162113 | A1* | 6/2017 | Lin | G09G 3/3233 |

FOREIGN PATENT DOCUMENTS

| | | | |
|---|---|---|---|
| CN | 103927971 | A | 7/2014 |
| CN | 104981862 | A | 10/2015 |
| CN | 105096786 | A | 11/2015 |
| CN | 105609024 | A | 5/2016 |

OTHER PUBLICATIONS

Notice of Transmittal of the International Search Report of PCT/CN2016/105212 in Chinese, dated Jan. 26, 2017.

Written Opinion of the International Searching Authority of PCT/CN2016/105212 in Chinese, dated Jan. 26, 2017 with English translation.

Chinese Office Action in Chinese Application No. 201610005272.X dated Nov. 16, 2017 with English translation.

* cited by examiner

TEST METHOD FOR DISPLAY PANEL, AND TEST DEVICE

CROSS REFERENCE TO RELATED APPLICATIONS

This application is the National Stage of PCT/CN2016/105212 filed on Nov. 9, 2016, which claims priority under 35 U.S.C. § 119 of Chinese Application No. 201610005272.X filed on Jan. 5, 2016, the disclosure of which is incorporated by reference.

TECHNICAL FIELD

Embodiments of the present disclosure relate to a test method for a display panel, and a test device.

BACKGROUND

Defects such as Mura (uneven display brightness) that may significantly affect display effect usually are occurred during an existing manufacturing process of display device. For example, in an Active-Matrix Organic Light Emitting Diode (AMOLED) display device, several factors such as default voltage drift, aging of OLED elements and craft difference between pixels may lead to difference in brightness between pixels, resulting in dark spots, dark regions or stripes displayed in an image, which severely influences the display effect of the image.

In order to prevent display panels with such kind of failures from being manufactured into final products by normal process, flowing into the market and finally resulting in waste of both human labors and materials, samples with such kind of failures must be detected quickly and timely during the manufacturing process of the display panels. In this regard, a light-on test may be performed to detect some obvious Mura failures from appearance of the samples, which however cannot comprehensively reflect subtle differences in brightness between pixels and may easily cause missing detection. As a result, the samples with certain failures may be transferred to subsequent processes and lead to waste of both human labors and materials.

SUMMARY

Embodiments of the present disclosure provide a test method for a display panel and a test device which can solve the problem of missing detection of Mura in existing manufacture process of display panel.

In order to achieve the objective above, the embodiments of the present disclosure adopt technical solutions as below.

On a first aspect, the embodiment of the present disclosure provides a test method for a display panel. The display panel includes plural pixel regions each including a light emitting element connected to a switching circuit, the switching circuit is configured to conduct a voltage at a first terminal of the light emitting element to a second terminal of the switching circuit upon a first terminal of the switching circuit being at an active level; a scan circuit connected to plural rows of first scan lines; and a sensor circuit connected to plural columns of sensing lines. Any switching circuit has the first terminal connected to one row of first scan lines and the second terminal connected to one column of sensing lines, and any two switching circuits connected to a same row of first scan lines are connected to different columns of sensing lines. The test method includes: outputting a data signal of a preset test image to the display panel to cause the light emitting element to emit light according to the test image; outputting a starting signal to the scan circuit to cause the scan circuit to output the active level to the plural rows of first scan lines connected thereto, successively, according to a preset timing sequence; receiving a sensing signal from the sensor circuit disposed in the display panel, wherein the sensing signal including voltage value information of the first terminal of every light emitting element, the voltage value information is obtained by the sensor circuit receiving voltage information from the plural columns of sensing lines through complying with the preset timing sequence; and comparing the voltage value information of the first terminal of every light emitting element in the sensing signal with the preset test image to obtain a test result.

In an example, comparing the voltage value information of the first terminal of every light emitting element in the sensing signal with the preset test image to obtain a test result includes: calculating a standard voltage value of the first terminal of every light emitting element according to the preset test image; comparing a voltage value of the first terminal of every light emitting element with the standard voltage value, and generating an abnormal signal upon a difference value between the voltage value and the standard voltage value exceeding a threshold value; and receiving the abnormal signal, and indicating a pixel with a coordinate corresponding to the abnormal signal as an abnormal pixel, in a test result image.

In an example, receiving a sensing signal from the sensor circuit disposed in the display panel includes: processing the sensing signal as received by one or more of signal distortion compensating, filtering, power amplifying and analog-to-digital converting.

In an example, the switching circuit includes a third transistor, a gate of the third transistor is connected to one row of first scan lines; one of a source and a drain of the third transistor is connected to the first terminal of the light emitting element, and the other is connected to one column of sensing lines.

In an example, the plural pixel regions are arranged in rows and columns; any row of first scan lines is located between adjacent two rows of pixel regions; and any column of sensing lines is located between adjacent two columns of pixel regions.

On a second aspect, the embodiment of the present disclosure provides a test device for a display panel. The display panel includes plural pixel regions each including a light emitting element connected to a switching circuit, the switching circuit is configured to conduct a voltage at a first terminal of the light emitting element to a second terminal of the switching circuit upon a first terminal of the switching circuit being at an active level; a scan circuit connected to plural rows of first scan lines; and a sensor circuit connected to plural columns of sensing lines. Any switching circuit has the first terminal connected to one row of first scan lines and the second terminal connected to one column of sensing lines, and any two switching circuits connected to a same row of first scan lines are connected to different columns of sensing lines. The test device includes: a first output circuit configured to output a data signal of a preset test image to the display panel to cause the plural light emitting elements to emit light according to the test image; a second output circuit configured to output a starting signal to the scan circuit to cause the scan circuit to output the active level to the plural rows of first scan lines connected thereto, successively, according to a preset timing sequence; a receiving circuit configured to receive a signal from the sensor circuit to generate a sensing signal, the sensing signal including voltage value information of the first terminal of every light emitting element, the voltage value information being obtained by the sensor circuit receiving voltage information from the plural columns of sensing lines through complying with the preset timing sequence; and a comparison circuit configured to compare the voltage value information of the first terminal of every light emitting element in the sensing signal with the preset test image to obtain a test result.

In an example, the receiving circuit is configured to process the signal as received by one or more of signal distortion compensating, filtering, power amplifying and analog-to-digital converting.

In an example, the comparison circuit includes: a calculation circuit configured to calculate a standard voltage value of the first terminal of every light emitting elements according to the preset test image; a comparison circuit configured to compare the voltage value of the first terminal of every light emitting element with the standard voltage value, and generate an abnormal signal upon a difference value between the voltage value and the standard voltage value exceeding a threshold value; and a display circuit configured to receive the abnormal signal, and display a pixel with a coordinate corresponding to the abnormal signal as an abnormal pixel in a test result image.

In an example, the switching circuit includes a third transistor; a gate of the third transistor is connected to one row of first scan lines; one of a source and a drain of the third transistor is connected to the first terminal of the light emitting element, and the other is connected to one column of sensing lines.

In an example, the plural pixel regions are arranged in rows and columns; any row of first scan lines is located between adjacent two rows of pixel regions; and any column of sensing lines is located between adjacent two columns of pixel regions.

BRIEF DESCRIPTION OF THE DRAWINGS

Hereafter, the embodiments of the present disclosure will be described in a more detailed way with reference to the accompanying drawings, so as make one person skilled in the art be able to understand the present disclosure more clearly, wherein.

DETAILED DESCRIPTION

Hereafter, the technical solutions in the embodiments of the present disclosure will be described in a clearly and fully understandable way in connection with the drawings in the embodiments of the present disclosure. It is obvious that the described embodiments are just a part but not all of the embodiments of the disclosure. Based on the described embodiments herein, one person skilled in the art can obtain other embodiment(s), without any inventive work, which should be within the scope of the disclosure.

Unless otherwise defined, the technical terminology or scientific terminology used herein should have the same meaning as commonly understood by one of ordinary skill in the art to which this disclosure belongs. Likewise, terms like "first," "second," etc., which are used in the description and the claims of the present application for disclosure, are not intended to indicate any sequence, amount or importance, but distinguish various components. The phrases "connect", "connected", etc., are not intended to define a physical connection or mechanical connection, but may include an electrical connection, directly or indirectly. "On," "under," "left," "right" or the like is only used to describe a relative positional relationship, and when the absolute position of a described object is changed, the relative positional relationship might also be changed accordingly.

Figure 1:
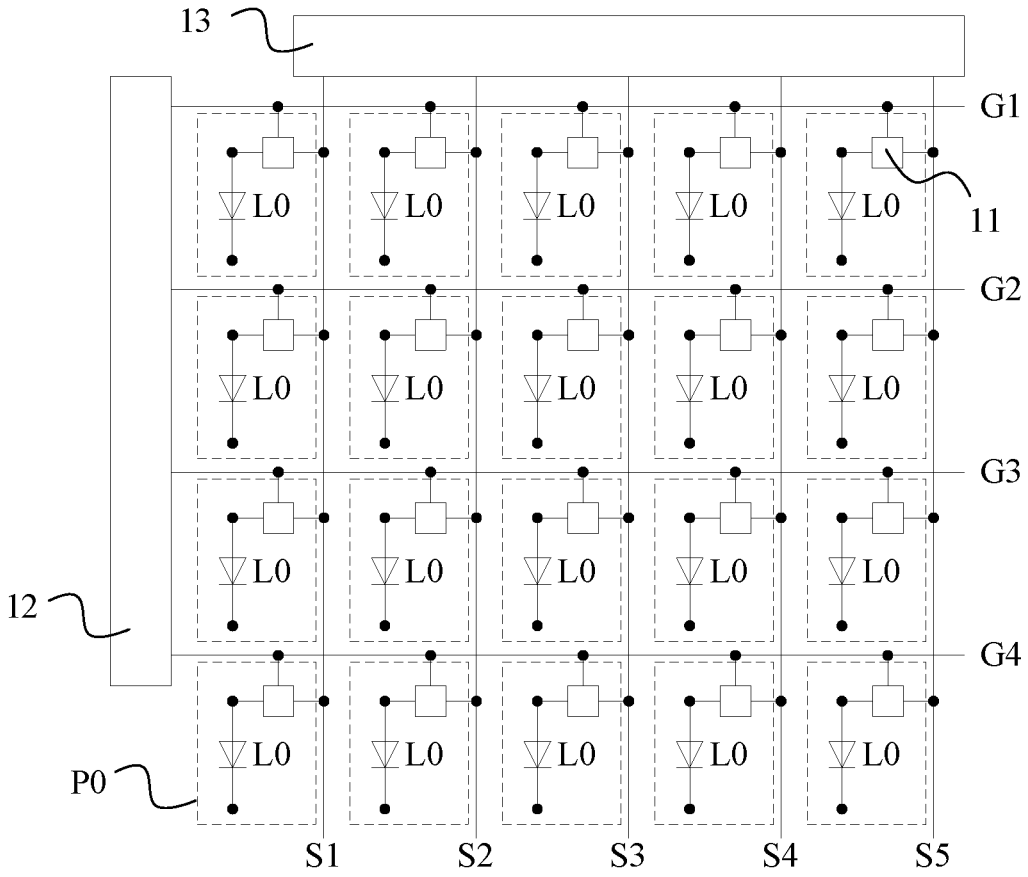
FIG. 1 is a schematic structural view of a display panel provided by an embodiment of the present disclosure.

FIG. 1 is a schematic structural view of a display panel provided by an embodiment of the present disclosure. With reference to FIG. 1, the display panel includes plural light emitting elements L0 disposed in plural pixel regions P0, respectively. It should be understood that, the light emitting element may be any electric component capable of emitting light, for example, organic light-emitting diode (OLED) or semiconductor light emitting diode (LED), etc. It should be explained that, FIG. 1 merely illustrates pixel regions arranged in four rows and five columns by way of example, although the specific number of the pixel regions and light emitting elements may be configured according to requirements of practical application scenarios.

In the embodiment of the present disclosure, the display panel may further include a switching circuit 11, a scan circuit 12 and a sensor circuit 13. The switching circuit 11 is disposed in every pixel region P0, and is configured to conduct a voltage at a first terminal (an upper terminal of the light emitting element L0 as illustrated in FIG. 1) of the light emitting element L0 to a second terminal (a right terminal of the switching circuit 11 as illustrated in FIG. 1) of the switching circuit 11 if a first terminal (an upper terminal of the switching circuit 11 as illustrated in FIG. 1) of the switching circuit 11 is at an active level. It should be explained that, the active level is one of parameters of the switching circuit 11, and may include one or more range of voltage value; thus the above function of the switching circuit 11 may be implemented by electric elements or a combination thereof known in the art, for example, hall switch, transistor or digital switch circuit; which can be selected by those skilled in the art according to actual needs, without particularly limited in the embodiments of the present disclosure.

In the embodiment of the present disclosure, the scan circuit 12 is connected to plural rows of first scan lines (FIG. 1 illustrates four rows of first san lines G1, G2, G3, G4), and is configured to output the active level of the switching circuit 11 to the plural rows of first scan lines, row by row, according a preset timing sequence. At the same time, referring to FIG. 1, any switching circuit 11 has the first terminal connected to one row of first scan lines; as a result, during the scan circuit 12 outputting the active level of the switching circuit 11 to any row of first scan lines, all the switching circuits 11 connected to these first scan lines can conduct the voltage at the first terminal of the light emitting elements L0 in the pixel region P0, where the switching circuits 11 are located, to the second terminals of the switching circuits 11. It should be explained that, the preset timing sequence includes a duration time of outputting the active level to every row of first scan lines, and a sequence of outputting the active level to the plural rows of first scan lines. Further, it should be understood that, the function of the scan circuit 12 may be implemented by a signal generation circuit or a variation thereof known in the art, for example, a multi-stage shift register may be used to successively output the active level on every row of first scan lines under an effect of clock signal; which can be selected by those skilled in the art according to actual needs, without particularly limited in the embodiments of the present disclosure.

In the embodiment of the present disclosure, the sensor circuit 13 is connected to plural columns of sensing lines (FIG. 1 illustrates five columns of sensing lines S1, S2, S3, S4, S5) and is configured to receive a voltage signal from the plural columns of sensing lines according to the preset timing sequence. At the same time, referring to FIG. 1, any switching circuit 11 has the second terminal connected to one column of sensing lines, and any two switching circuits connected to a same row of first scan lines are connected to different columns of sensing lines. In this way, when any switching circuit 11 conducts the voltage at the first terminal of the light emitting element L0 in the pixel region P0, where the switching circuit 11 is located, to the second terminal of the switching circuit 11, the sensor circuit 13 can receive the voltage signal of the sensing lines connected to the switching circuit 11 through the sensing lines, so as to obtain a specific value of the voltage at the first terminal of the light emitting element L0. It should be explained that, the time and the sequence of starting the light emitting elements 11 are determined by the preset timing sequence, thus the sensor circuit 13 has to comply with the preset timing sequence to obtain the specific values at the first terminals of all the light emitting elements L0 through the plural commons of sensing lines. It should also be understood that, the function of the sensor circuit 13 may be implemented by a signal acquisition circuit or a variation thereof known in the art, for example, the sensor circuit 13 may include a buffer, an analog-to-digital convertor and a memory in a sequence of receiving the voltage signal; which can be selected by those skilled in the art according to actual needs, without particularly limited in the embodiments of the present disclosure.

Thus it can be seen that, with the arrangement of the switching circuit, the first scan line and the sensing line in the display panel provided by the embodiments of the present disclosure, the voltage value of the first terminal of the light emitting element can be obtained; in this way, Mura detection can be realized during a test by comparing the voltage value as obtained with a theoretical value. That is, the embodiments of the present disclosure detect the existence of Mura directly by quantized values, which not only possesses higher accuracy but also allows automatic detection process, thereby facilitating to improve the test efficiency of the process flow.

Further, it should be explained that, in the structure of the display panel as illustrated in FIG. 1, the plural pixel regions PO are arranged in rows and columns; any row of first scan lines is located between adjacent two rows of pixel regions P0, and any column of sensing lines is located between adjacent two columns of pixel regions P0. Thus, in the embodiments of the present disclosure, the first scan lines and the sensing lines are arranged in a way similar to that of gate lines and data lines in a normal display panel, which reduces the difficulty of wiring and allows reuse of scan driver circuit and data driver circuit. However, in some other embodiments of the present disclosure, the pixel regions PO may not be arranged exactly in rows and columns, but staggered in row direction or column direction. In either arrangement, the first terminal of any switching circuit is connected to one row of first scan lines and the second terminal of any switching circuit is connected to one column of sensing lines in the display panel, thus all the voltage values at the first terminals of the plural light emitting elements in the display panel can be obtained as long as any two switching circuits connected to the same row of scan lines are connected to different columns of sensing lines, so as to solve the problem of missing Mura detection, without particularly limited in the embodiments of the present disclosure.

Figure 2:
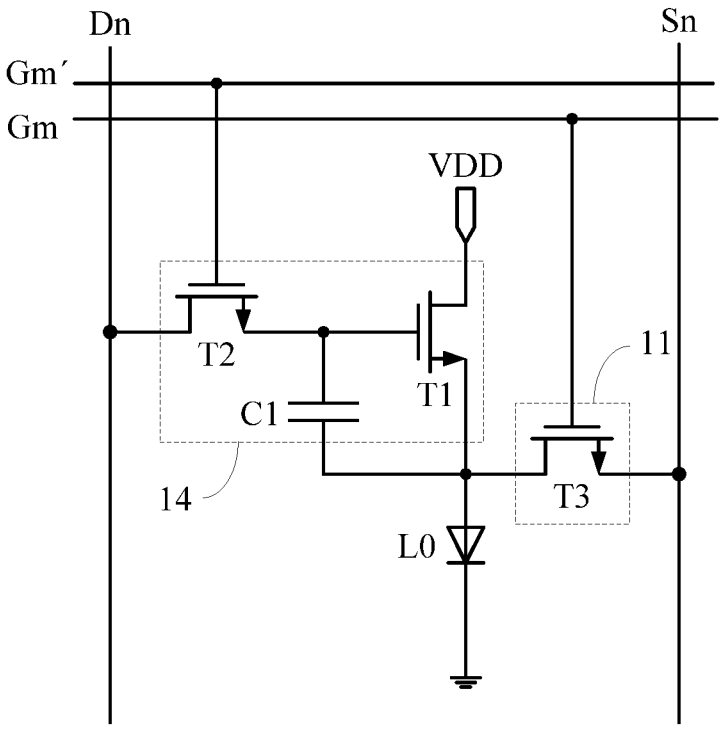
FIG. 2 is a schematic structural view of a circuit in a pixel region of the display panel provided by the embodiment of the present disclosure.

FIG. 2 is a schematic structural view of a circuit in a pixel region of the display panel provided by the embodiment of the present disclosure. Referring to FIG. 2, in the display panel, apart from the light emitting element L0 and the switching circuit 11, every pixel region may further include a pixel circuit 14 connected to the first terminal (the upper terminal of the light emitting element L0 as illustrated in FIG. 2) of the light emitting element L0, and the pixel circuit 14 in every pixel region is connected to one row of second scan lines and one column of data lines. The pixel circuit 14 is configured to receive a data voltage of the data line when the second scan line is at an active level, and supply the light emitting element with driving current according to the amplitude of the data voltage. It should be understood that, plural rows of second scan lines may be arranged in one-to-one correspondence with the plural rows of first scan lines illustrated in FIG. 1; and plural columns of data lines may be arranged in one-to-one correspondence with the plural columns of sensing lines illustrated in FIG. 1. For example, any row of second scan lines may be located between adjacent two rows of pixel regions; and any column of data lines may be located between adjacent two columns of pixel regions. By way of example, the pixel circuit 14 in the pixel region as illustrated in FIG.2 is connected to the second scan line Gm' and the data line Dn, wherein the second scan line Gm' and the first scan line Gm constitute a pair of row direction leads disposed in parallel, while the data line Dn and the sensing line Sn constitute a pair of column direction leads disposed in parallel. It should be understood that, as the plural rows of second scan lines output the active level row by row, any pixel circuit may supply the light emitting element in the pixel region with the driving current according to the amplitude of the data voltage on the data line as connected, when the second scan line as connected is at an active level. In this way, the arrangement of the driving current for the light emitting elements in every pixel region is achieved at an appropriate timing sequence, so as to realize the light-emitting display of the entire display panel. Of course, depending on the display requirements, the second scan line and the data line may be arranged in other different ways (e.g., different numbers or locations) in some other embodiments of the present disclosure.

In an example, as illustrated in FIG. 2, the pixel circuit 14 has a circuit structure including a first transistor T1, a second transistor T2 and a first capacitor C1. A gate of the first transistor T1 is connected to a first terminal of the first capacitor C1; one of a source and a drain of the first transistor T1 is connected to a bias voltage line VDD, and the other is connected to a second terminal of the first capacitor C1 and the first terminal of the light emitting element L0. A gate of the second transistor T2 is connected to one row of second scan lines Gm'; one of a source and a drain of the second transistor T2 is connected to one column of data lines Dn, and the other is connected to a first terminal of the first capacitor C1. It should be understood that, in FIG.

2, an upper terminal of the first capacitor C1 is the first terminal thereof, while a lower terminal of the first capacitor C1 is the second terminal thereof. Further, the first transistor T1 and the second transistor T2 illustrated in FIG. 2 both are N-type transistor, thus the drain of the first transistor T1 is connected to the bias voltage line VDD while the source of the first transistor T1 is connected to the second terminal of the first capacitor C1; and the drain of the second transistor T2 is connected to the data line Dn while the source of the second transistor T2 is connected to the first terminal of the first capacitor C1. It should be understood that, when the first transistor T1 and the second transistor T2 both are P-type transistor, the connections of the source and drain described above may be exchanged with each other; further, for example, when the drain and the source in the transistor are symmetric, they may be regarded as being identical.

Thus, when the second scan line Gm' outputs the active level, namely high level (determined by the characteristic of the N-type second transistor T2) of the pixel circuit 14, the second transistor T2 may be turned on to allow the first capacitor C1 to be charged with the data voltage on the data line Dn; in this way, a voltage difference (determining the magnitude of the maximum current passing through the source and the drain of the first transistor T1) between the gate and the source of the first transistor T1 working in a linear region is determined by electric charge amount stored in the first capacitor C1, that is, indirectly determined by the amplitude of the data voltage on the data line Dn; as a result, the first transistor T1 may generate a driving current between the bias voltage line VDD (may be applied with a bias high voltage ELVDD of light emitting element) and a common voltage line (may be applied with a bias low voltage ELVSS of light emitting element) connected to the second terminal of the light emitting element L0, so as to achieve the function of the pixel circuit 14, wherein the magnitude of the current is determined by the amplitude of the data voltage. Of course, in other embodiments of the present disclosure, the pixel circuit 14 may further include additional structures or may have different circuit structure. By way of example, the pixel circuit may be configured like that in the normal OLED display device, without limiting the embodiments of the present disclosure thereto.

Moreover, in the structure illustrated in FIG. 2, the switching circuit 11 may include a third transistor T3. A gate of the third transistor T3 is connected to the first scan line Gm, one of a source and a drain of the third transistor T3 is connected to the first terminal of the light emitting element L0 and the other is connected to the sensing line Sn. It should be understood that, although the third transistor T3 is illustrated in FIG. 2 as a N-type transistor (the source is connected to the sensing line Sn, and the drain is connected to the first terminal of the light emitting element L0), it may be a P-type transistor (the drain is connected to the sensing line Sn, and the source is connected to the first terminal of the light emitting element L0) in other embodiments of the present disclosure, without particularly limited herein. Further, when the source and the drain of the transistor are symmetric, they may be regarded as being identical. Thus, when the first scan line Gm is at an active level, namely high level (determined by the characteristic of the P-type third transistor T3), the source and the drain of the third transistor T3 may be turned on to achieve the function of the switching circuit 11. It should be understood that, the process of forming the switching circuit 11 by using the transistor may be adapted to the existing manufacturing process of display panel, which facilitates reducing the cost and improving the performance.

It should be explained that, FIG. 2 illustrates an anode of a diode serving as the first terminal of the light emitting element by way of example. In other embodiments of the present disclosure, a cathode of the diode may be served as the first terminal of the light emitting element, and the second terminal of the light emitting element may, instead, be connected to the bias high voltage ELVDD. In this way, the bias voltage line connected to the first transistor will be applied with the bias low voltage ELVSS, which can also achieve the detection of the voltage at the first terminal of the light emitting element.

Based on the same inventive concept, embodiments of the present disclosure further provide a display device including any foregoing display panel. It should be explained that, the display device may be any product or component with display function such as digital paper, mobile phone, tablet computer, television, notebook computer, digital photo frame and navigator. For example, the display device may be an OLED display, without particularly limiting the embodiments of the present disclosure thereto. The display device includes the foregoing display panel, and correspondingly can achieve automatic detection and facilitate improving the detection efficiency of the process flow.

Figure 3:
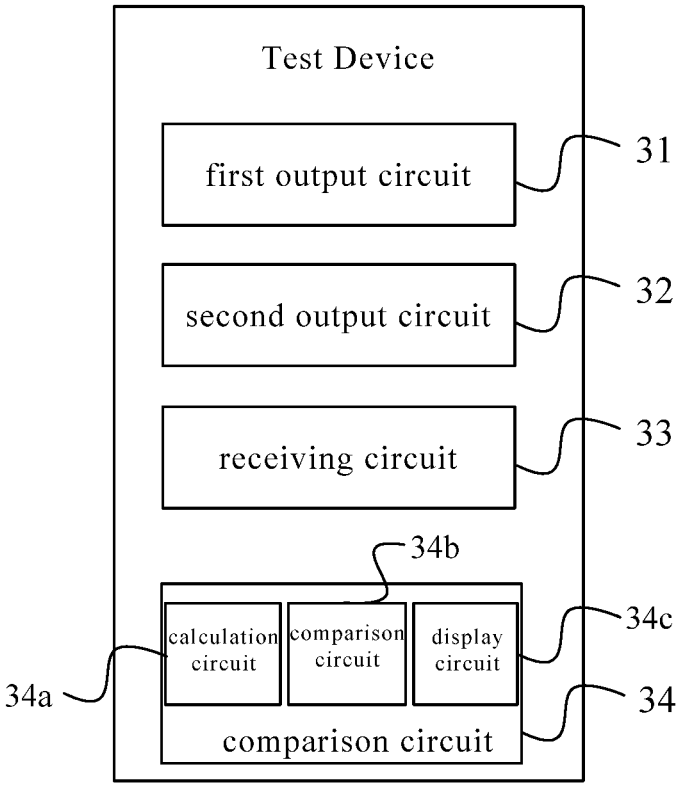
FIG. 3 is a block diagram illustrating a structure of a test device for a display panel provided by an embodiment of the present disclosure.

FIG. 3 is a block diagram illustrating a structure of a test device for any of the foregoing display panels, provided by an embodiment of the present disclosure. With reference to FIG.3, the test device includes a first output circuit 31, a second output circuit 32, a receiving circuit 33 and a comparison circuit 34.

The first output circuit 31 is configured to output a data signal of a preset test image to the display panel to cause the light emitting elements to emit light according to the preset test image.

The second output circuit 32 is configured to output a starting signal to the scan circuit to cause the scan circuit to output the active level to the plural rows of first scan lines connected thereto, successively, according to a preset timing sequence.

The receiving circuit 33 is configured to receive a signal from the sensor circuit to generate a sensing signal including voltage value information of the first terminal of every light emitting element.

The comparison circuit 34 is configured to compare the sensing signal with the preset test image to obtain a test result.

For example, the first output circuit 31 may include a test image signal source connected to a display signal input terminal of the display panel, so that the display signal of the preset test image (e.g., single-colored image, stripe image, preset picture image) may be used for light-emitting control of the light emitting element to allow the plural light emitting elements in the display panel to emit light according to the preset test image.

For example, the second output circuit 32 may include a pulse signal generator to output a pulse signal to the scan circuit including the multi-stage shift register as the starting signal during a specific first time period, so that the scan circuit can output the active level of the switching circuit to one row of the plural rows of scan lines during subsequent every time period.

It should be understood that, the sensor circuit 13 may receive a group of voltage values through the plural columns of scan lines during every time period, and store the same in a memory successively. In this regard, the receiving circuit 33 may include a reading component in the memory of the sensor circuit so as to generate digital sensing signal successively. The digital sensing signal includes voltage value information at the first terminals of the light emitting elements in every row and every column of pixel regions (that is, including both a voltage value of any light emitting element and a location identifier of the pixel region where the light emitting element is located, e.g., a signal formed by plural subpulses in which the voltage value is represented by amplitude value). In some embodiments, the receiving circuit 33 may be configured to process the signal as received by one or more of signal distortion compensating, filtering, power amplifying and analog-to-digital converting. It should be understood that, a parasitic capacitance effect on the sensing lines may affect a reading speed and lead to signal attenuation and also output signal distortion. Thus the signal processing performed in the receiving circuit can eliminate these influences subjected by the sensing signal so as to improve the detection accuracy.

Based on the sensing signal (representing an actual voltage value measured at the first terminal of the light emitting element) obtained by the receiving circuit 33 and the preset test image (representing a standard voltage value at the first terminal of the light emitting element), the comparison circuit 34 may achieve Mura (uneven display brightness) detection. For example, when Mura is occurred, the actual voltage value measured at the first terminal of the light emitting element in the pixel region where the failure is generated would be significantly deviated from the standard voltage value; in this way, the Mura may be detected.

In an example, still with reference to FIG. 3, the comparison circuit 34 may include a computation circuit 34*a*, a comparison m circuit 34*b* and a display circuit 34*c*. The calculation circuit 34*a* is configured to calculate the standard voltage value at the first terminal of every light emitting element according to the preset test image. The comparison circuit 34*b* is configured to compare the actual voltage value at the first terminal of every light emitting element with the standard voltage value, and generate an abnormal signal when a difference value between the actual voltage value and the standard voltage value exceeds a preset threshold value. The display circuit 34*c* is configured to receive the abnormal signal, and display a pixel with a coordinate corresponding to the abnormal signal as an abnormal pixel in a test result image.

Figure 4:
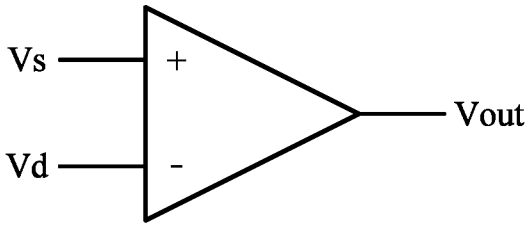
FIG. 4 is a block diagram illustrating a structure of a data comparator in the test device for a display panel provided by the embodiment of the present disclosure.

For example, the calculation circuit 34*a* may include a logic operation circuit with a fixed arithmetic to convert the display signal input in a digital form into the standard voltage value at the first terminal of every light emitting element. The comparison circuit 34*b* may include one or more of the data comparator as illustrated in FIG. 4 to implement the comparison between the actual voltage value as measured and the standard voltage value. For example, every voltage value Vs in the sensing signal and the standard voltage value obtained by the calculation circuit 34*a* may be input into two input terminals of the data comparator, respectively; thus the voltage difference value Vout output by the data comparator reflects the difference between the actual measurement value and the standard voltage value at the first end of the light emitting element L0. As a result, when the voltage difference value exceeds a threshold value, or when a ratio of the voltage difference value and the standard voltage value exceeds a preset ratio, the comparison circuit 34*b* generates the abnormal signal to indicate that an anomaly is occurred in the driving voltage of the light emitting element in a certain pixel region. Finally, the display circuit 34*c* may process the abnormal signal into a test result image by means of a logic operator; for example, various ways such as marking with red color, lighting on, and flashing may be used to indicate an existence of an abnormal pixel at a corresponding coordinate so as to indicate whether the voltage applied on the light emitting element is normal or not in a visual manner for the tester.

Of course, the working principle of the circuits above is mainly described with reference to digital signal processing by way of example, although it should be understood that the data comparator as illustrated in FIG. 4, apart from a digital circuit such as deviation calculation circuit, may also be an analog circuit such as a differential amplifier, as long as it achieves a comparison between two voltage values; so that analog signal processing may also be utilized to implement the function of the comparison circuit 34, without limiting the embodiments of the present disclosure thereto.

As above, the test device provided by the embodiment of the present disclosure may be cooperated with the display panel described in any of the foregoing embodiments to achieve Mura detection, so as to solve the problem of missing detection, which not only possesses higher accuracy but also allows automatic detection process, thereby facilitating to improve the test efficiency of process flow.

Figure 5:
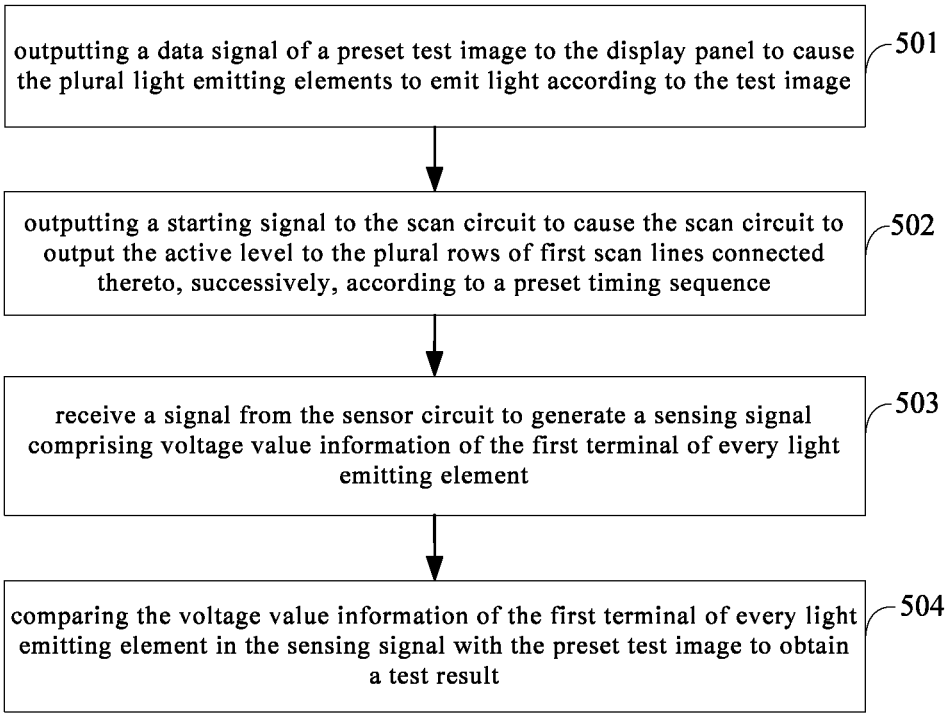
FIG. 5 is a flow chart of a test method for a display panel provided by an embodiment of the present disclosure.

Based on the same inventive concept, embodiments of the present disclosure further provide a test method for a display panel, as illustrated in FIG. 5. With reference to FIG. 5, the test method is applicable to any of the foregoing display panel, including steps as below.

Step 501, outputting a data signal of a preset test image to the display panel to cause the plural light emitting elements to emit light according to the preset test image.

Step 502, outputting a starting signal to the scan circuit to cause the scan circuit to output the active level of the switching circuit to the plural rows of first scan lines, successively, according to a preset timing sequence.

Step 503, receiving a sensing signal from the sensor circuit, the sensing signal includes voltage value information of the first terminal of every light emitting element.

Step 504, comparing the voltage value information of the first terminal of every light emitting element in the sensing signal with the preset test image to obtain a test result.

It should be understood that, the steps S501-S504 correspond to the functions of the first output circuit 31, the second output circuit 32, the receiving circuit 33 and the comparison circuit 34, respectively, and hence may be implemented in a similar manner without repeating herein. As it can be seen, the test method provided by the embodiment of the present disclosure may be cooperated with the display panel described in any of the foregoing embodiments to achieve Mura detection so as to solve the problem of missing detection, which not only possesses higher accuracy but also allows automatic detection process, thereby facilitating to improve the test efficiency of process flow.

The present disclosure contains plenty of specific details. However, it should be understood that the embodiments of the present disclosure may be implemented without such specific details. In some examples, the methods, structures and/or technology known in the art are omitted with particular description thereof, so as not to obscure the technical solution of the present disclosure.

Similarly, it should be understood that, in order for simplification of the present disclosure and also for understanding of one or more aspects of the present disclosure, several features may be combined and applied in a single embodiment, a single figure or relevant description, which however is not intended to limit the present disclosure as protected to include more features than those defined in the claims. More specifically, as reflected by the appended claims, every aspect of the present disclosure may contain fewer features than that in the single embodiment as disclosed. Therefore, the claims following specific embodiments would be definitely incorporated into the specific embodiments; and every claim, per se, would be regarded as a single embodiment of the present disclosure.

It is understood that the described above are just exemplary implementations and embodiments to explain the principle of the present disclosure and the disclosure is not intended to limit thereto. An ordinary person in the art can make various variations and modifications to the present disclosure without departure from the spirit and the scope of the present disclosure, and such variations and modifications shall fall in the scope of the present disclosure.

The present application claims the benefits of Chinese patent application No. 201610005272.X filed with the SIPO on Jan. 5, 2016, which is incorporated herein by reference as part of the application.

The invention claimed is:

1. A test method for a display panel, the display panel comprising plural pixel regions each comprising a light emitting element connected to a switching circuit and a pixel circuit connected to a first terminal of the light emitting element, the pixel circuit being connected to one row of second scan lines and one column of data lines, the switching circuit being configured to conduct a voltage at the first terminal of the light emitting element to a second terminal of the switching circuit upon a first terminal of the switching circuit being at an active level; a scan circuit connected to plural rows of first scan lines; and a sensor circuit connected to plural columns of sensing lines; wherein any switching circuit having the first terminal connected to one row of first scan lines and the second terminal connected to one column of sensing lines, and any two switching circuits connected to a same row of first scan lines being connected to different columns of sensing lines, the data lines and the sensing lines being arranged in one-to-one correspondence, for each of the pixel regions, the second scan line connected to the pixel circuit and the first scan line connected to the switching unit being arranged to be adjacent to and parallel with each other, the test method comprising:

outputting a data signal of a preset test image to the pixel circuit in the display panel to cause the light emitting element to emit light according to the preset test image, comprising: the pixel circuit receiving a data voltage from the data line upon the second scan line connected to the pixel circuit being at an active level and applying the light emitting element with a driving current according to an amplitude of the data voltage on the data line;

outputting a starting signal to the scan circuit to cause the scan circuit to output the active level of the switching circuit to the plural rows of first scan lines as connected, successively, according to a preset timing sequence;

receiving a sensing signal from the sensor circuit disposed in the display panel, wherein the sensing signal comprising voltage value information of the first terminal of every light emitting element, the voltage value information being obtained by the sensor circuit receiving voltage information from the plural columns of sensing lines through complying with the preset timing sequence; and comparing the voltage value information of the first terminal of every light emitting element in the sensing signal with the preset test image to obtain a test result.

2. The test method of claim 1, wherein comparing the voltage value information of the first terminal of every light emitting element in the sensing signal with the preset test image to obtain a test result comprises:

calculating a standard voltage value of the first terminal of every light emitting element according to the preset test image;

comparing a voltage value of the first terminal of every light emitting element with the standard voltage value, and generating an abnormal signal upon a difference value between the voltage value and the standard voltage value exceeding a threshold value; and receiving the abnormal signal, and indicating a pixel with a coordinate corresponding to the abnormal signal as an abnormal pixel, in a test result image.

3. The test method of claim 2, wherein the switching circuit comprises a third transistor, a gate of the third transistor is connected to one row of first scan lines;

one of a source and a drain of the third transistor is connected to the first terminal of the light emitting element, and the other is connected to one column of sensing lines.

4. The test method of claim 2, wherein the plural pixel regions are arranged in rows and columns;

any row of first scan lines is located between adjacent two rows of pixel regions; and any column of sensing lines is located between adjacent two columns of pixel regions.

5. The test method of claim 1, wherein receiving a sensing signal from the sensor circuit disposed in the display panel comprises:

processing the sensing signal as received by one or more of signal distortion compensating, filtering, power amplifying and analog-to-digital converting.

6. The test method of claim 5, wherein the switching circuit comprises a third transistor, a gate of the third transistor is connected to one row of first scan lines;

one of a source and a drain of the third transistor is connected to the first terminal of the light emitting element, and the other is connected to one column of sensing lines.

7. The test method of claim 5, wherein the plural pixel regions are arranged in rows and columns;

any row of first scan lines is located between adjacent two rows of pixel regions; and any column of sensing lines is located between adjacent two columns of pixel regions.

8. The test method of claim 1, wherein the switching circuit comprises a third transistor, a gate of the third transistor is connected to one row of first scan lines;

one of a source and a drain of the third transistor is connected to the first terminal of the light emitting element, and the other is connected to one column of sensing lines.

9. The test method of claim 1, wherein the plural pixel regions are arranged in rows and columns;

any row of first scan lines is located between adjacent two rows of pixel regions; and any column of sensing lines is located between adjacent two columns of pixel regions.

10. The test method of claim 1, wherein the first scan lines are isolated from the second scan lines.

11. A test device for a display panel, the display panel comprising plural pixel regions each comprising a pixel circuit and a light emitting element connected to a switching circuit, the pixel circuit being connected to one row of second scan lines and one column of data lines, the switching circuit being configured to conduct a voltage at a first terminal of the light emitting element to a second terminal of the switching circuit upon a first terminal of the switching circuit being at an active level; a scan circuit connected to plural rows of first scan lines; and a sensor circuit connected to plural columns of sensing lines; wherein any switching circuit having the first terminal connected to one row of first scan lines and the second terminal connected to one column of sensing lines, and any two switching circuits connected to a same row of first scan lines being connected to different columns of sensing lines, the data lines and the sensing lines being arranged in one-to-one correspondence; for each of the pixel regions, the second scan line connected to the pixel circuit and the first scan line connected to the switching unit being arranged to be adjacent to and parallel with each other, the test device comprising:

a first output circuit configured to output a data signal of a preset test image to the pixel circuit in the display panel to cause the light emitting element to emit light according to the test image, wherein the pixel circuit is configured to receive a data voltage from the data line upon the second scan line connected to the pixel circuit being at an active level and apply the light emitting element with a driving current according to an amplitude of the data voltage on the data line;

a second output circuit configured to output a starting signal to the scan circuit to cause the scan circuit to output the active level to the plural rows of first scan lines connected thereto, successively, according to a preset timing sequence;

a receiving circuit configured to receive a signal from the sensor circuit to generate a sensing signal, the sensing signal comprising voltage value information of the first terminal of every light emitting element, the voltage value information being obtained by the sensor circuit receiving voltage information from the plural columns of sensing lines through complying with the preset timing sequence; and a comparison circuit configured to compare the voltage value information of the first terminal of every light emitting element in the sensing signal with the preset test image to obtain a test result.

12. The test device of claim 11, wherein the receiving circuit is configured to process the signal as received by one or more of signal distortion compensating, filtering, power amplifying and analog-to-digital converting.

13. The test device of claim 12, wherein the switching circuit comprises a third transistor;

a gate of the third transistor is connected to one row of first scan lines;

one of a source and a drain of the third transistor is connected to the first terminal of the light emitting element, and the other is connected to one column of sensing lines.

14. The test device of claim 12, wherein the plural pixel regions are arranged in rows and columns;

any row of first scan lines is located between adjacent two rows of pixel regions; and any column of sensing lines is located between adjacent two columns of pixel regions.

15. The test device of claim 11, wherein the comparison circuit comprises:

a calculation circuit configured to calculate a standard voltage value of the first terminal of every light emitting elements according to the preset test image;

a comparison circuit configured to compare the voltage value of the first terminal of every light emitting element with the standard voltage value, and generate an abnormal signal upon a difference value between the voltage value and the standard voltage value exceeding a threshold value; and a display circuit configured to receive the abnormal signal, and display a pixel with a coordinate corresponding to the abnormal signal as an abnormal pixel in a test result image.

16. The test device of claim 15, wherein the switching circuit comprises a third transistor;

a gate of the third transistor is connected to one row of first scan lines;

one of a source and a drain of the third transistor is connected to the first terminal of the light emitting element, and the other is connected to one column of sensing lines.

17. The test device of claim 15, wherein the plural pixel regions are arranged in rows and columns;

any row of first scan lines is located between adjacent two rows of pixel regions; and any column of sensing lines is located between adjacent two columns of pixel regions.

18. The test device of claim 11, wherein the switching circuit comprises a third transistor;

a gate of the third transistor is connected to one row of first scan lines;

one of a source and a drain of the third transistor is connected to the first terminal of the light emitting element, and the other is connected to one column of sensing lines.

19. The test device of claim 11, wherein the plural pixel regions are arranged in rows and columns;

any row of first scan lines is located between adjacent two rows of pixel regions; and any column of sensing lines is located between adjacent two columns of pixel regions.

20. The test device of claim 11, wherein the first scan lines are isolated from the second scan lines.

* * * * *